United States Patent [19]

Junkers

[11] 4,336,727

[45] Jun. 29, 1982

[54] HYDRAULIC WRENCH FOR LIMITED SPACE APPLICATION

[76] Inventor: John K. Junkers, 7 Arrowhead La., Saddle River, N.J. 07458

[21] Appl. No.: 126,859

[22] Filed: Feb. 28, 1980

[51] Int. Cl.[3] ..... B25B 13/46

[52] U.S. Cl. ..... 81/57.39; 74/128

[58] Field of Search ..... 81/57.39; 74/128, 577 R, 74/577 M

[56] References Cited

U.S. PATENT DOCUMENTS

| | | | |
|---|---|---|---|
| 2,758,569 | 8/1956 | Peterson | 81/57.39 |
| 4,200,011 | 4/1980 | Wilmeth | 81/57.39 |
| 4,201,099 | 5/1980 | Junkers | 81/57.39 |

*Primary Examiner*—James L. Jones, Jr.
*Attorney, Agent, or Firm*—Michael J. Striker

[57] ABSTRACT

A hydraulically operated wrench for turning a threaded connector, especially in applications in which the space above and around the threaded connector is rather limited. The wrench has a socket formed with a polygonal passage therethrough to be engaged with a polygonal head of the threaded connector to be tightened or loosened. The socket is turned about its axis by the reciprocation of a piston of a fluid operated cylinder and piston unit and ratchet pawls tiltably connected to the free end of the piston rod of the unit and engaging with the teeth of a ratchet wheel fixed to the peripheral surface of the socket. In order to hold the outer diameter of the rim forming the ratchet wheel as small as possible while not unduly weaken the same, the rim is formed in the region of the corners of the polygonal passage extending through the socket with solid uninterrupted portions between which the teeth of the ratchet wheel are cut into the rim and the stroke of the piston is made in such a manner that the pawls after engaging the teeth to one side of a solid portion will, during the following forward stroke of the piston, engage with the teeth on the other side of the respective solid portion.

17 Claims, 4 Drawing Figures

HYDRAULIC WRENCH FOR LIMITED SPACE APPLICATION

BACKGROUND OF THE INVENTION

The present application relates to a hydraulic wrench and especially to a hydraulic wrench for limited space applications, that is to applications in which the polygonal head of a threaded connector which has to be tightened or loosened by the wrench is located in a space which is rather limited about the axis of the threaded connector and above the polygonal head to be tightened or loosened thereon. In such limited space applications hydraulically operated wrenches as for instance disclosed in the U.S. Pat. No. 4,027,561 could not be used and it was up to now common practice to use a common flat wrench having at one end a passage of polygonal cross-section for engagement with a polygonal head of a threaded connector and a handle projecting from the aforementioned one end of the wrench and in which hammer blows have been exerted onto the free end of the handle to tighten or loosen the polygonal head of the threaded connector. The disadvantage of this known arrangement is of course, that the force at which a series of polygonal heads have been tightened on the threaded connectors depends on the force of the hammer blows and evidently a uniform tightening of a series of polygonal heads on a series of threaded connectors could not be assured.

SUMMARY OF THE INVENTION

It is therefore an object of the present invention to provide a hydraulic wrench which can be applied to the polygonal head of a threaded connector to tighten and loosen the same in which the space about the polygonal head and above the same is rather limited.

With these and other objects in view, which will become apparent as the description proceeds, the hydraulic wrench according to the present invention mainly comprises support means, fluid operated means including a cylinder mounted in the support means, a piston reciprocatable along the axis of the cylinder and a piston rod fixed to the piston for reciprocation therewith, a socket having an outer cylindrical surface and being mounted in the support means for turning about a second axis normal to and laterally off the axis of the cylinder, in which the socket is formed with a passage of polygonal cross-section therethrough extending along the second axis for engagement with a polygonal head of a threaded connector to be turned, and in which the corner of the polygonal passage are closely adjacent to the outer peripheral surface of the socket. Ratchet means are provided between the fluid operated means and the socket for turning the latter about the second axis during reciprocation of the piston in the cylinder. This ratchet means comprise pawl means tiltably connected to the piston rod and a ratchet wheel fixed to the outer peripheral surface of the socket and having an outer cylindrical rim concentric with the outer surface of the socket and a series of circumferentially spaced solid uninterrupted portions respectively arranged in the regions of the corners of the passage and gear teeth cut into the rim between the solid portions to be engaged by the pawl means, so that considerably forces may be used for tightening the head of a threaded connector without any danger of destroying the socket and the gear wheel connected thereto.

The support means preferably comprise an elongate base plate, which preferably has a width smaller than the diameter of the cylinder, and a pair of side plates respectively connected to opposite sides of the base plate and projecting with front end portions beyond the front end of the latter. The front end portions of the side plates are provided with aligned bores therethrough extending along the second axis in which a pair of opposite end portions of the socket are mounted for rotation, while the ratchet wheel is located between the side plates.

The rear end of the cylinder is tiltably mounted in end portions of the side plates projecting at the rear end of the base plate transversely to the latter for tilting about an axis substantially parallel to the second axis.

The front end portions of the side plates are further provided with curved slots aligned in transverse direction with each other in which opposite end portions of a pin turnably mounted in a bore on the free end of the piston rod are respectively guided and the pawl means are tiltably mounted on this pin.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
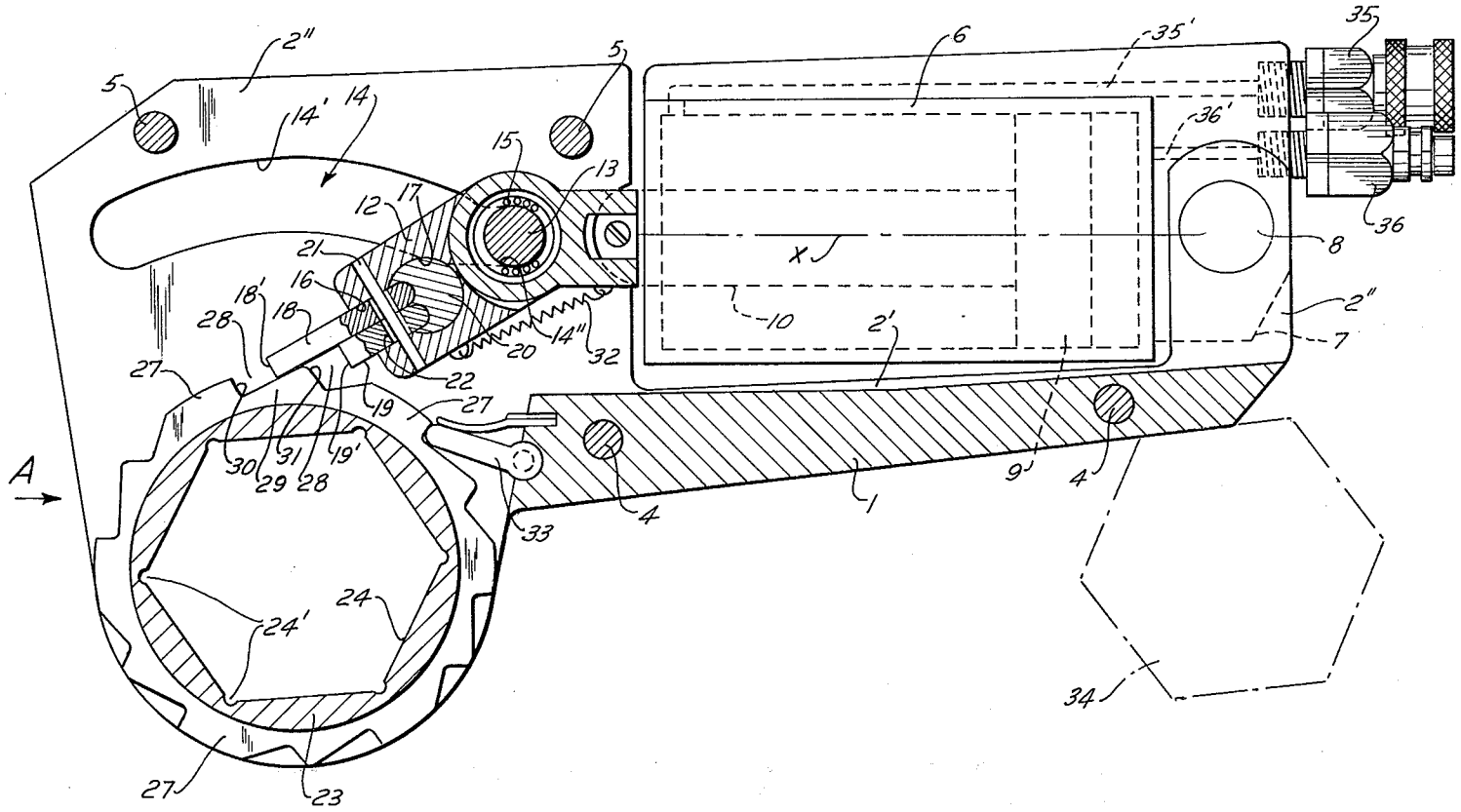
FIG. 1 is a partly sectioned side view of the hydraulic wrench according to the present invention, the section being taken along the line I—I of FIG. 3.
Figure 2:
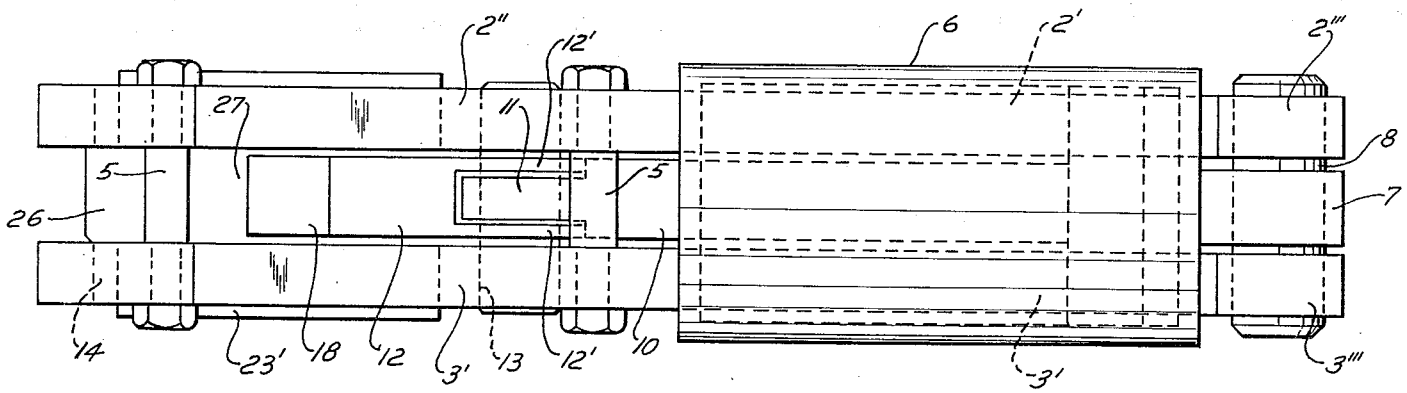
FIG. 2 is a top view of the wrench shown in FIG. 1.
Figure 3:
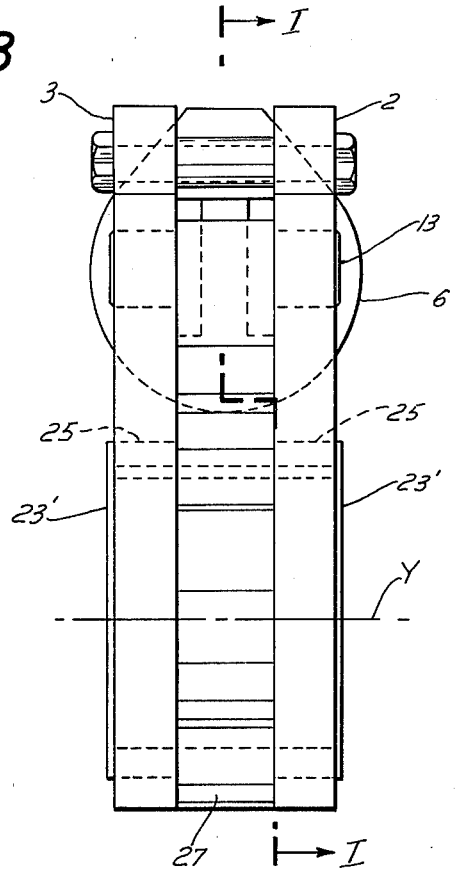
FIG. 3 is a front view of the wrench as seen in the direction of the arrow A of FIG. 1.

Referring now to the drawings, it will be seen that the hydraulic wrench according to the present invention comprises support means including a base plate 1 and two side plates 2 and 3 connected to opposite sides of the base plate 1 by screw bolts 4, whereas the front end portions of the side plates 2 and 3 projecting beyond the base plate 1 are held spaced transversely from each other by spacer bolts 5 of a construction best shown in FIG. 2. As can be seen from FIG. 1, the side plate 2 has a middle portion 2' or a width substantially equal to the thickness of the base plate, a front end portion 2'', that is the left end portion as viewed in FIG. 2 of the side plate 2, extending to opposite sides beyond the base plate 1 and a rear or right end portion 2'' of relatively small width projecting upwardly of the base plate 1. It is to be understood that the side plate 3, not seen in FIG. 1, has the same configuration as the side plate 2.

A cylinder 6 of a fluid operated cylinder and piston unit is located between the front end and the rear end portions of the side plates 2 and 3. The cylinder is provided at its rear end, that is the right end as viewed in FIG. 1, with a boss 7 projecting between the rear and portions of the side plates 2 and 3, and the latter, as well as the boss 7 are formed with aligned bores therethrough through which a pin 8 extends for pivotally mounting the rear end of the cylinder on the upwardly projecting rear end portions of the side plates 2 and 3. The piston rod 10 projecting forwardly from the piston 9 slidably guided in the cylinder has a flattened end portion 11 embraced by the arms 12' of a ratchet pawl holding member 12. The arms 12' and the flattened end portion 11 of the piston rod 10 are formed with aligned bores therethrough through which a pivot pin 13 extends and opposite end portions of the pivot pin 13 are respectively guided in slots 14 provided in the front end portions 2" and 3" of the side plates 2 and 3. A pair of needle bearings 15 are preferably provided on the portions of the pivot pin 13 which extend through the bores in the arms 12' of the ratchet pawl holding member 12, so that the latter may freely pivot about the pivot pin 13.

The front portion of the pawl holding member 12 is formed with a transverse slot 16 therethrough which communicates at its rear end with a bore 17 likewise extending transversely through the ratchet pawl holding member 12. A pair of superimposed, substantially plate shaped pawls 18 and 19 are tightly fitted in the slot 16, of which the upper pawl 18 is longer than the lower pawl 19 for a purpose as will be described later on. The rear ends of the pawls 18 and 19 are rounded and abut against correspondingly rounded cutouts in an abutment pin 20 of hardened material located in the bore 17. A fastening pin 21 extends with clearance through aligned bores 22 provided adjacent to the rear ends through the pawls 18 and 19 to substantially prevent lateral movement of the pawls 18 and 19 after the same have been slipped sidewise into the slot 16 formed in the front end portion of the ratchet pawl holding member 12. The opposite end portions of the holding pin 21 extend with a tight fit through corresponding bores in the ratchet pawl holding member 12. A socket 23 has opposite end portions 23' turnably mounted in bores 25 in the side plates 2 and 3 so that the socket 23 is turnable about an axis y substantially normal and laterally displaced form the axis x of the cylinder 6. The socket 23 is formed with a hexagonal passage 24 therethrough for engagement with a corresponding hexagonal head of a threaded connector to be turned by the wrench. The rim of a ratchet wheel 26 is integrally formed with the outer peripheral surface of the socket 23 between the side plates 2 and 3. To be able to apply the wrench to the head of a threaded connector in which the space about the head is rather limited, the outer peripheral surface of the rim of the ratchet wheel 26 is rather closely spaced to the hexagonal passage 24 extending through the socket 23. If gear teeth would be provided in close succession about the whole rim of the ratchet wheel 26, the danger would exists that this rim of the ratchet wheel may be torn in the region of the corners of the passage 24 under the high pressure imparted by the pawls of the ratchet mechanism against the teeth. To avoid this danger, the rim of the ratchet wheel is formed in the region of the corners 24' of the hexagonal passage 24 through the socket 23 with solid uncut portions 27. These solid portions 27 are circumferentially displaced from each other through 60°. A pair of cutouts 28 of substantially triangular configuration are cut circumferentially spaced from each other between each of successive solid portions 27 to form a tooth 29 therebetween and two abutment faces 30 and 31 against which the end faces 18' and 19' of the two superimposed pawls 19 and 19 are adapted to abut during the active stroke of the piston 9, so as to turn the socket 23 in counterclockwise direction about the axis y. The abutment face 30 of the cutout 28 leading in the direction of rotation of the socket is located in radial plane including the axis y, whereas the abutment face 31 extends parallel to the abutment face 30. Since the end faces 18' and 19' of the two pawls 18 and 19 are likewise parallel and since the pawl 19 is shorter than the pawl 18, the two end faces 18' and 19' are adapted to simultaneously engage the abutment faces 30 and 31 during the forward stroke of the piston, so that the pressure exerted by the piston is equally distributed onto the two pawls and onto the abutment faces 30 and 31. The above-mentioned mounting of the pawls will permit a slight adjustment of the same relative to each other if, in view of the tolerances for the pawl length and tolerances in cutting the abutment faces 30 and 31, an equal division of the forces applied by the two pawls should not be initially accomplished.

Since the abutment faces 30 and 31 are also displaced through an angle of 60° from the following abutment faces 30 and 31, the piston 9 in the cylinder 6 must have a stroke length so that after the socket 23 has been turned through an angle of 60° during the forward stroke of the piston in which the pawl ends 18' and 19' respectively engage a pair of abutment faces 30 and 31, the pawls will have to ratchet during the return stroke of the piston 9 to be ready during the next forward stroke to engage the following abutment faces 30 and 31. Preferably, the pawls should slightly override the following abutment faces during the return stroker of the piston 9. For this purpose the slots 14 provided in the front end portions 2' and 3' of the side plates 2 and 3 have each curved portions 14' extending through 60° concentric with the axis y of the socket 23 and at the right end a short substantially straight portion 14" extending substantially in the direction of the axis x of the cylinder 6. Opposite ends of a coil tension spring 32 are connected, as shown in FIG. 1, to the ratchet pawl holding member 12 and to the projecting end of the piston rod 10 for biasing the pawls 18 and 19 into engagement with the rim 27 of the ratchet wheel. The wrench includes also, as usual, a spring pressed holding pawl 33 which may be turnably mounted in the base plate 1 for preventing any return movement of the socket 23.

Since during turning of the head of a threaded connector in one direction a moment is exerted on the wrench tending to turn the same in the opposite direction, the base plate 1 has an outer surface 1' adapted to abut against a fixed abutment, for instance, a head 34 of a threaded connector adjacent the one to be turned by the wrench, as indicated in dash-dotted lines in FIG. 1, to counteract this turning moment. FIG. 1 indicates also a pair of sockets 35 and 36 connected to the rear end of the piston 6 and respectively communicating with channels 35' and 36' for feeding, respectively discharging, pressure fluid, perferably oil under pressure, to and from opposite ends of the cylinder 6 to reciprocate the piston 9 therein. It is to be understood that a valve of known construction and not forming part of the present invention is to be connected to conduits leading to the sockets 35 and 36 to alternatingly feed pressure fluid from a source of pressure fluid not illustrated in the drawing into the socket 35, respectively 36, respectively to discharge pressure fluid therefrom to a likewise non-illustrated tank.

Figure 4:
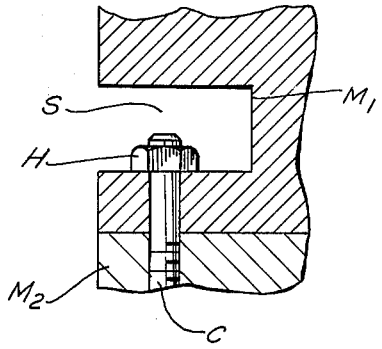
FIG. 4 schematically shows a threaded connector to which the wrench of the present invention can be applied and in which the space about the polygonal head of the threaded connector which has to be tightened or loosened by the wrench, as well as the space above the threaded connector is rather limited.

FIG. 4 schematically illustrates the head H of a threaded connector C in which the space S above and to one side of the head is rather limited by a member $M_1$ which is to be fastened by the threaded connector to a member $M_2$. It is in such applications in which the hydraulic wrench of the present invention can be used, due to the small radial distance of the outer periphery of the rim of the ratchet wheel 26 from the corner 24' of the passage 24 through the socket 23.

It will be understood that each of the elements described above, or two or more together, may also find a useful application in other types of hydraulic wrenches differing from the types described above.

While the invention has been illustrated and described as embodied in a hydraulic wrench for turning the head of a threaded connector in which the space for applying the wrench above the head of the threaded connector and laterally therefrom is rather limited, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic wrench comprising support means; fluid operated means including a cylinder having an axis and being mounted on said support means against movement in axial direction, a piston reciprocatable along said axis in said cylinder and a piston rod fixed to said piston for reciprocation therewith; a socket having an outer cylindrical surface and being mounted on said support means for turning about a second axis substantially normal to and laterally of said cylinder, said socket being formed with a passage of polygonal cross-section therethrough extending along said second axis for engagement with a polygonal head of a threaded connector to be turned, the corners of said polygonal passage being closely adjacent to said outer peripheral surface of said socket; and ratchet means between said fluid operated means and said socket for turning the latter about said second axis during reciprocation of said piston in said cylinder, said ratchet means comprising pawls means tiltably connected to said piston rod and a ratchet wheel fixed to said outer peripheral surface of said socket, said ratchet wheel having an outer cylindrical rim concentric with said outer surface and having a series of circumferentially spaced solid uninterrupted portions respectively arranged in the regions of said corners of said passage and gear teeth in said rim between said solid portions to be engaged by said pawl means, so that considerable forces may be used for tightening the head of a threaded connector without any danger of destroying said socket or said ratchet wheel.

2. A hydraulic wrench as defined in claim 1, wherein said support means comprises an elongated base plate having a front end and a rear end and a pair of side plates respectively connected to opposite sides of said base plate and projecting with front end portions beyond the front end of the latter, said cylinder being mounted on portions of said side plates adjacent said rear end of said base plate, said side plates being provided with aligned bores therethrough extending along said second axis and said socket having a pair of opposite end portions turnably mounted in said bores, said ratchet means being located between said side plates.

3. A hydraulic wrench as defined in claim 2, wherein said cylinder has a rear end adjacent said rear end of said base plate, wherein said side plates have end portions projecting in the region of the rear end of said base plate transversely to the latter, and including means mounting said rear end of said cylinder on said end portions of said side plates tiltable about an axis substantially parallel to said second axis.

4. A hydraulic wrench as defined in claim 3, wherein said front end portions of said side plates are respectively provided with curved slots aligned in transverse direction with each other, said piston rod having a free end portion formed with a bore therethrough substantially parallel to said second axis, a pin mounted in said bore and having opposite end portions respectively guided in said slots, said pawl means being tiltably mounted on said pin.

5. A hydraulic wrench as defined in claim 4, wherein said pawl means comprises a pawl holder member tiltably mounted at one end thereof on said pin and a pair of super-imposed pawls carried by said pawl holder member with the free end of the upper of said superimposed pawls projecting farther from the other end of said pawl holder member than the lower one so that the free ends of said pawls may simultaneously engage a pair of adjacent abutment faces of teeth in said rim.

6. A hydraulic wrench as defined in claim 5, wherein said passage through said socket is a hexagonal passage and wherein said cylinder and said piston are constructed so that during each forward stroke of said piston said socket is turned through an angle of 60° and wherein successive solid portions on said rim are circumferentially spaced through 60° from each other and wherein said rim has a pair of abutment faces between each of said successive solid portions to be simultaneously engaged by said pawls during forward stroke of said piston in said cylinder.

7. A hydraulic wrench as defined in claim 6, wherein said slots in said side plates have each a curved main portion concentric with said second axis and extending through 60° and a short straight end portion adjacent said front end of said cylinder and extending substantially in the direction of the axis of the latter, to permit a slight overriding of said pawls.

8. A hydraulic wrench as defined in claim 7, wherein said two superimposed pawls have parallel end faces adapted to respectively engage a pair of adjacent pawl engagement faces of said rim, and wherein one engagement face of each pair leading in the direction of rotation of said socket extends in a radial plane including said second axis, and the other engagement face of each pair extends parallel to said one engagement face.

9. A hydraulic wrench as defined in claim 8, wherein said pawls have rounded rear ends and including a hardened cylindrical abutment member in a bore of said pawl holder member and provided with cutouts into which said rounded rear ends of said pawl engages to permit a slight adjustment of said end faces of said pawls relative to each other to assure that the end faces will simultaneously engage a pair of pawl engagement faces on said rim.

10. A hydraulic wrench as defined in claim 8, and including spring means connected to said pawl holder member for maintaining said pawl in engagement with said rim.

11. A hydraulic wrench as defined in claim 6, and including a spring pressed retaining pawl mounted on said support means and adapted to engage an engagement face in said rim trailing in direction of rotation of said socket the engagement faces engaged by said pawls.

12. A hydraulic wrench as defined in claim 2, wherein said base plate has an outer face adapted to engage an abutment adjacent the threaded connector to be turned to counteract a turning moment imparted to the wrench during tightening or loosening of a threaded connector.

13. A hydraulic wrench as defined in claim 1, wherein said gear wheel is integral with said socket.

14. A hydraulic wrench as defined in claim 2, wherein said base plate has a width smaller than the diameter of said cylinder.

15. A wrench comprising support means; a socket having an outer cylindrical surface and being mounted on said support means turnably about the axis of said cylindrical surface, said socket being formed with a passage of polygonal cross sections therethrough coaxial with said axis for engagement with a polygonal head of a threaded connector to be turned, the corners of said polygonal passage being closely adjacent to said outer peripheral surface of said socket; ratchet means including a ratchet pawl and a ratchet wheel fixed to said outer peripheral surface of said socket, said ratchet wheel having an outer cylindrical rim concentric with and fixed to said outer peripheral surface and having a series of circumferentially spaced solid uninterrupted portions respectively arranged in the regions of said corners of said passage and gear teeth in said rim between said solid portions to be engaged by said pawl; and means mounted on said support means and operatively connected to said pawl for moving the latter along an active stroke for turning said socket and a return stroke, thereby considerable forces may be used for tightening the head of a threaded connector without any danger of destroying said socket or said ratchet wheel.

16. A wrench comprising support means including a pair of transversely spaced side plates, said side plates being provided with a pair of bores therethrough aligned along a common axis and with a pair of transversely aligned curved slots substantially concentric with said common axis and spaced from said bores; a socket provided with a passage of polygonal cross section therethrough for engagement with a polygonal head of a threaded connector to be turned, said socket having a pair of opposite end portions with outer cylindrical surfaces which are respectively arranged in said bores in said side plates for turnably mounting said socket in said side plates; a ratchet wheel coaxially fixed to said socket between said side plates, said ratchet wheel having a plurality of circumferentially spaced teeth; ratchet pawl means between said side plates and having a front portion arranged for engagement with said teeth and a rear portion provided with a bore therethrough extending substantially normal to said side plates and a pin turnably mounted in said bore and having a pair of opposite end portions respectively engaged and guided in said slots of said side plates; and means mounted on said support means and operatively connected to said pin for reciprocating the latter along said slots to thereby move said pawl means along an active stroke turning said socket and a return stroke.

17. A wrench as defined in claim 15, wherein said support means comprises a pair of transversely spaced side plates provided with a pair of bores therethrough aligned with said axis and with a pair of transversely spaced curved slots substantially concentric with said axis and spaced from said bores, said sockets having a pair of opposite end portions turnably mounted in said bores, said ratchet wheel and said ratchet pawl being located between said side plates, said ratchet pawl having a front portion arranged for engagement with the teeth of said ratchet wheel and a rear portion provided with a bore therethrough extending substantially normal to said side plates, and including a pin turnably mounted in said bore of said pawl and having a pair of opposite end portions respectively guided for movement in said slot, said moving means being operatively connected to said pin to reciprocate the latter along said slots to thereby move said pawl along said active and said return stroke.

* * * * *